United States Patent [19]

Forbes et al.

[11] Patent Number: 4,870,770

[45] **Date of Patent: * Oct. 3, 1989**

[54] SAFETY MECHANISM FOR FIREARMS

[75] Inventors: Melvin D. Forbes, Granville; William F. Malone, Jr., Morgantown, both of W. Va.

[73] Assignee: Ultra Light Arms, Inc., Granville, W. Va.

[ * ] Notice: The portion of the term of this patent subsequent to Mar. 15, 2005 has been disclaimed.

[21] Appl. No.: 167,591

[22] Filed: Mar. 14, 1988

Related U.S. Application Data

[63] Continuation-in-part of Ser. No. 680,328, Dec. 10, 1918, Pat. No. 4,730,406.

[51] Int. Cl.[4] ..... F41C 17/08

[52] U.S. Cl. ..... 42/70.01; 42/70.05

[58] Field of Search ..... 42/70.01, 70.05

[56] References Cited

U.S. PATENT DOCUMENTS

| | | | |
|---|---|---|---|
| 2,514,981 | 7/1950 | Walker et al. | 42/69 |
| 2,595,834 | 5/1952 | Fleenor | 42/70 |
| 2,869,269 | 1/1959 | Couture | 42/70 |
| 3,138,888 | 6/1964 | Brewer | 42/70 |
| 3,782,022 | 1/1974 | Bielfeldt et al. | 42/70 |
| 3,949,509 | 4/1976 | Larsson | 42/70 |
| 4,730,406 | 3/1988 | Forbes et al. | 42/70.01 |

*Primary Examiner*—Deborah L. Kyle
*Assistant Examiner*—Richard W. Wendtland
*Attorney, Agent, or Firm*—Duckworth, Allen, Dyer & Doppelt

[57] ABSTRACT

A three-position firearm safety mechanism has bolt lock arm, user-operated lever and sear safety arm including inner eccentric end members interconnected by a trigger assembly pin, with the lower blade-like end of the lever slidably received within an outwardly facing channel on the sear safety arm and having a boss connected to an offset eccentric aperture in the lower arm, to permit the bolt lock arm to be temporarily disengaged from the bolt notch by depressing the lever against a spring bias while the safety is rotated to the firearm "safe" position.

15 Claims, 2 Drawing Sheets

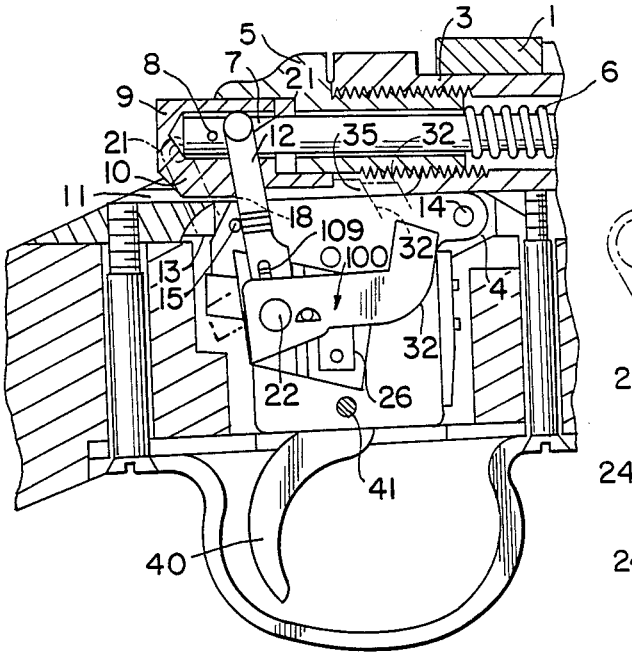
FIG. 1
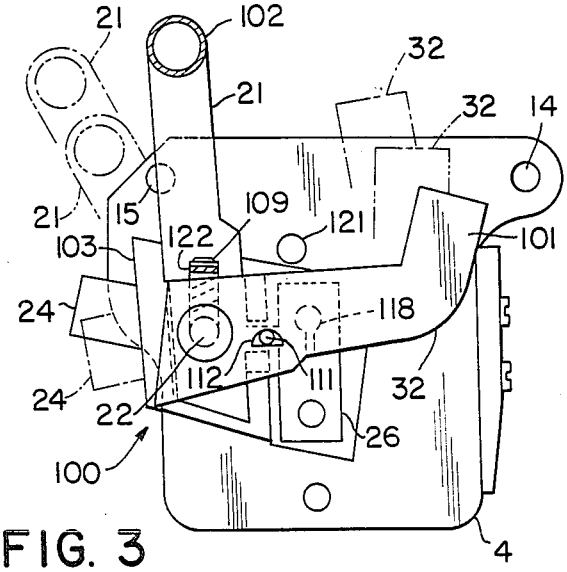
FIG. 3
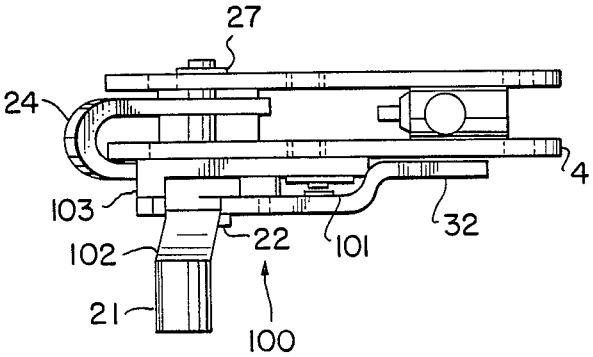
FIG. 2
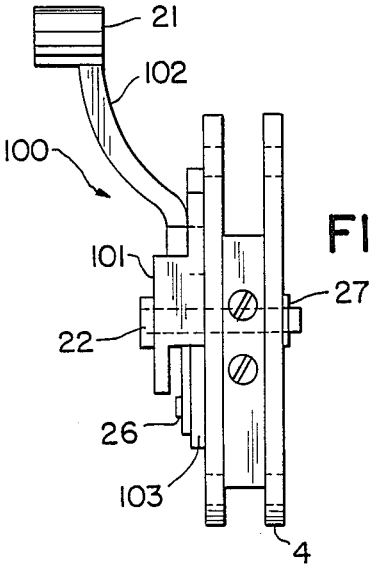
FIG. 4
FIG. 5
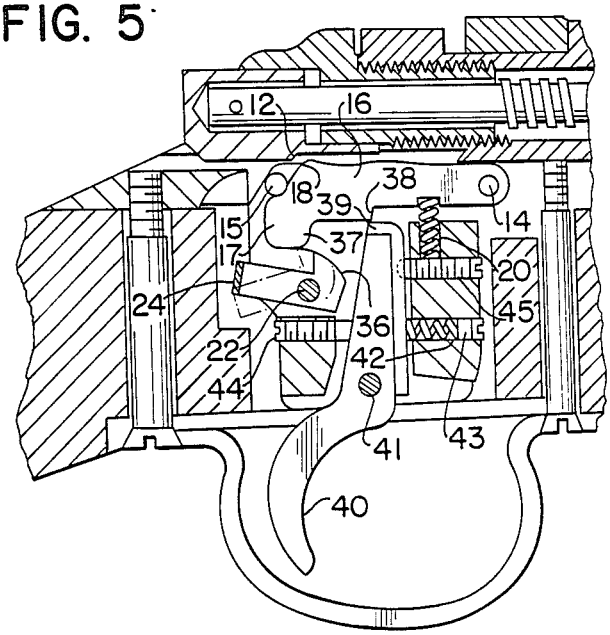

SAFETY MECHANISM FOR FIREARMS

CROSS-REFERENCE TO RELATED APPLICATIONS

This is a continuation-in-part of U.S. patent application Ser. No. 680,328 filed 12/10/84 (U.S. Pat. No. 4,730,406), the benefit of whose filing data is claimed under 35 U.S.C. 120 and all the disclosure of which is incorporated herein by reference.

BACKGROUND OF THE INVENTION

This invention relates to improvements in safety mechanisms for firearms; and, especially, to improvements in safety mechanisms employing means maintaining the firearm in a "safe" position by blocking movement of the firing pin and/or by blocking movement of the trigger or sear.

A typical conventional safety mechanism of the type to which the invention has application is shown in Walker et al U.S. Pat. No. 2,514,981. The Walker mechanism has a safety pivotally mounted for rotation about a pivot pin for bringing a bolt lock arm portion up into bolt movement blocking position within a notch in the bolt, while simultaneously bringing the eccentric end of an inner arm portion into sear movement blocking position with the heel of a sear safety cam. The details of such a conventional system are set forth in that patent, incorporated herein by reference, and the reader is referred thereto for additional background.

The Walker and similar safety mechanisms function by moving between two positions: a "safe" position in which the bolt and sear (or trigger) are blocked, and a "fire" position in which the bolt and sear are unobstructed. Movement from one position to the other is normally accomplished by manual rotation of an elongated lever arm portion (typically having an enlarged head of some kind) of the safety, that projects upwardly to the outside of the firearm to a position easily accessible by the thumb of the shooter. In a typical such arrangement, a ball detent loosely seated in a hole formed in the bolt lock arm portion of the safety is biased by means of a leaf spring into alternative engagement with one of two detent holes formed in the side wall of the trigger housing to releasably detain the safety in its desired one of the two positions.

The redundancy afforded by having both bolt blocking and sear blocking means, as in the Walker mechanism, is helpful so that inadvertent pressing of the trigger while the safety is in the "safe" position will not condition the firearm to subsequently fire as soon as the safety is released. Such two-position mechanisms, however, have the disadvantage that the bolt cannot be drawn back to unload the weapon or remove the bolt without first placing the safety in the "fire" position to release the bolt lock arm portion.

SUMMARY OF THE INVENTION

It is an object of the invention to provide a firearm safety mechanism that employs both firing pin and sear (or trigger) blocking means, while also permitting the bolt to be drawn back for unloading or bolt removal without the need to place the safety in a firearm "fire" position.

This and other objects of the invention are accomplished by providing a fire control device having a three-position or three-stage safety which includes a safety lever movable from a "fire" position to a "safe" position to bring a bolt lock arm into bolt (vis. firing pin) blocking position and at the same time bring an inner arm into sear blocking position; and which is movable while in the "safe" position to a third position in which the bolt lock arm can be temporarily disengaged, to enable the bolt to be drawn backwards to check the chamber or remove the bolt, without moving the inner arm.

The provision of bolt blocking means in addition to sear blocking means enables the trigger and sear springs to immediately reposition the mechanism to catch the firing pin upon release of the safety, should the trigger be operated while the safety is engaged. In addition, the provision of the third position, enables the user to release, lift, and rotate the bolt while the safety is in the "safe" position, thus preventing the firearm from being accidentally discharged during unloading and cleaning.

The invention can be adapted to existing firearms with either the older or more recent two-stage top or side safety trigger blockage or sear blockage safety devices to enhance their handling safety. In addition, the invention can be applied to future manufactured conventional firearm triggers and custom mechanisms employing trigger block or sear safety devices, including side, cross-bolt and tang type trigger safety mechanisms.

BRIEF DESCRIPTION OF THE DRAWING

Embodiments of the invention have been chosen for purposes of illustration and description, and are shown in the accompanying drawings, wherein:

FIG. 1 is a longitudinal sectional view of a portion of a conventional firearm, showing installation of a safety mechanism in accordance with the invention;

FIG. 2 is a top plan view of the safety mechanism of FIG. 1;

FIG. 3 is a right side elevation view of the mechanism of FIG. 1;

FIG. 4 is a front elevation view of the mechanism of FIG. 1;

FIG. 5 is a view similar to that of FIG. 1, with the section taken inside the right plate of the trigger housing.

Throughout the drawings, like elements are referred to by like numerals.

DETAILED DESCRIPTION OF THE PREFERRED EMBODIMENT

Figure 6:
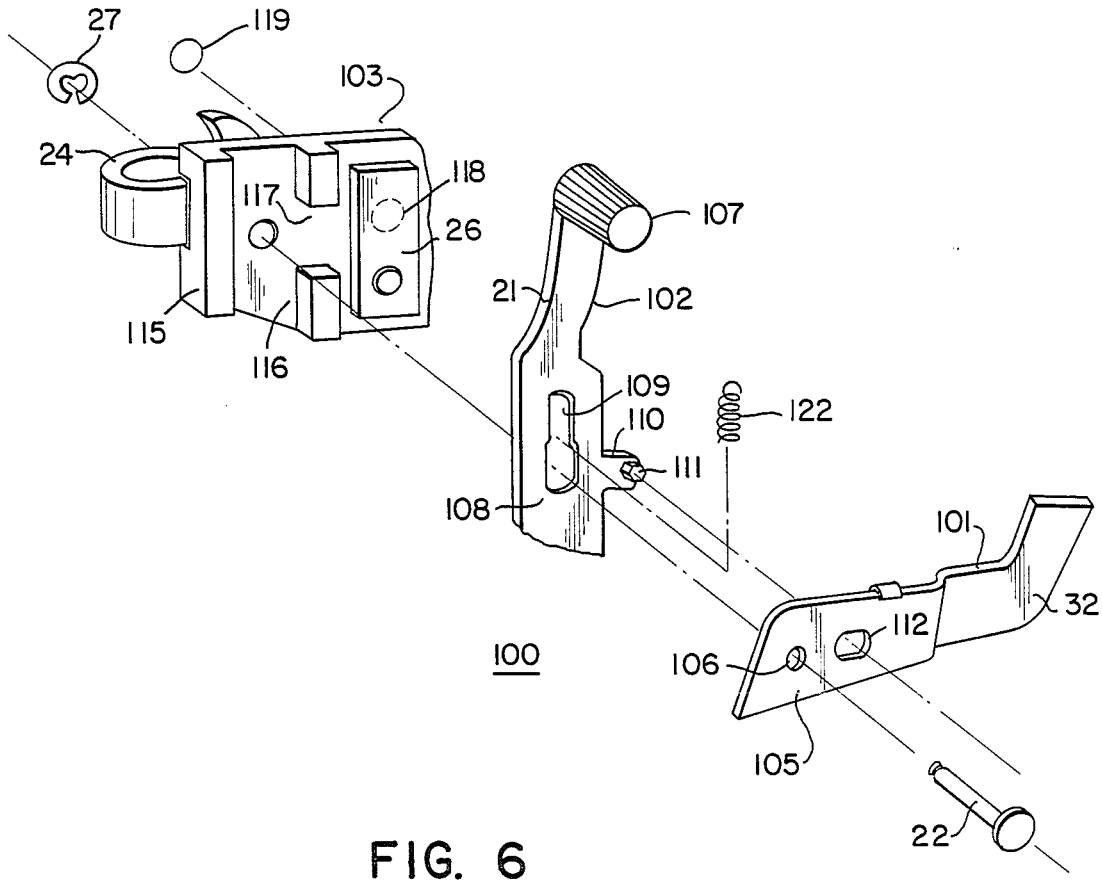
FIG. 6 is an exploded view of the main components of the safety mechanism shown in FIGS. 1-5.

The invention represents an improvement in safety mechanisms for firearms, such as the safety mechanism shown in Walker et al U.S. Pat. No. 2,514,981. FIGS. 1 and 5 show an implementation of the improved safety mechanism of the invention utilized in conjunction with conventional trigger and other components of a conventional firearm in views corresponding to the views found in FIGS. 1 and 5 of the Walker patent.

As in Walker, it may be seen that the portion of a firearm action which is illustrated comprises a receiver 1 which serves as a housing for a conventional type of upturn and pull back bolt 3 and as a mounting for a trigger housing 4. In the usual fashion, the rear end of the bolt is closed with a bolt plug 5 which serves as an abutment for the mainspring 6 and as a guide for the firing pin 7. Secured on the rear end of the firing pin by a cross pin 8 is a firing pin head or cocking piece 9. The cocking piece is formed with a rib 10 which is slidably received in a groove 11 in the receiver and with an angularly disposed sear engaging face 12, all as shown in FIG. 1 of Walker.

A longitudinally extending mortise 13 is milled through the bottom wall of the receiver to accommodate the trigger housing 4 which is secured therein by cross pins 14 and 15 (FIG. 3) mounted in the receiver and passing through the trigger housing assembly to serve as pivots and stops for elements therein.

Between the side plates of the trigger housing 4, the front cross pin 14 pivotally supports the sear 16 (FIG. 5) and the safety cam 17. It will be appreciated that the sear and safety cam are of conventional gun manufacturer design and may be formed as separate elements (FIGS. 1 and 5 of Walker) or as a single unitary piece (FIG. 5 hereof). The sear/safety cam is provided with a striker engaging surface 18 (FIG. 5), the angular relationship between this striker engaging surface and the sear engaging face 12 being such that there is a tendency for the sear/safety cam to swing counter-clockwise about the pivot pin 14 under the urging of the mainspring 6 which acts through the firing pin 7. This tendency is slightly resisted by a sear spring 20 (FIG. 5) which engages the sear/safety cam with sufficient pressure to urge the sear to turn clockwise when it is free from the firing pin load until it is stopped by engagement with pin 15. The tendency of the sear 16 to rotate itself out of engagement with the cocking piece 9 in the non-firing position is resisted by engagement of the step 38 (FIG. 5) of the sear with a connector 39, which is bent to substantially a right angle and lies against the front face and over the top of trigger 40 which is pivotally mounted on a pin 41 passing through the side plates of the trigger housing 4. A trigger spring 42 seats against an screw 43 and bears on the forward face of the connector 39 resilently urging the connector into engagement with the trigger 40 and through the connector 39, resilently urging the upper end of the trigger rearwardly. Movement of the trigger is limited in extent by an adjustable rear stop screw 44 which limits the amount of engagement which the connector has with the sear step 38. A forward stop screw 45 serves as a convenient support for the sear spring 20 and passes freely through a hole in the connector to oppose the trigger proper, thereby providing an adjustment to trigger movement.

As in the Walker patent, a safety mechanism 100 is pivotally mounted on a pivot pin 22 for movement of a bolt lock arm 32 and an eccentric 36 (FIG. 5) of an inner arm 24 from a first "fire" position (shown in solid lines in FIGS. 1, 3 and 5) to a second "safe" position (shown in dot-and-dash lines), in response to movement of a lever 21 from a corresponding first to a corresponding second position about the pin 22 (see FIGS. 1 and 3). Movement of the safety from the "fire" position into the "safe" position, moves the bolt lock arm 32 of the safety 100 upwardly through the bottom wall of the receiver into engagement with a notch 35 in the bolt, to lock the same against rotation when the safety has been turned to its counterclockwise limit of rotation or "safe" position. In the clockwise or "firing" position, bolt lock arm 32 does not extend through the receiver wall and the bolt may be readily turned to unlock the action.

When the lever is brought from the clockwise "fire" position to its "safe" position, the eccentric 36 (FIG. 5) is brought into sear movement blocking position beneath the heel 37 of the safety cam (which may be a single unit with the sear, as already mentioned). With the safety in the "fire" position, the eccentric 36 does not engage the safety cam 17 and release of the cocking piece 9 by the sear 16 will permit the safety to be cammed out of the way. However, when the safety has been rotated into "safe" position, the eccentric 36 has engaged the heel of the safety cam and lifted it slightly. Since the safety cam 17 engages the cocking piece 9 on an angle, the effect of this upward movement will be to cam the cocking piece 9 slightly to the rear. This rearward movement ensures that the sear 17 will be returned by the sear spring 20 to position for full engagement with the cocking piece 9 if the trigger 40 should be inadvertently operated while the safety is effected.

With the firing mechanism described in the Walker patent, although the redundancy afforded by having both the bolt locking and sear blocking means to prevent firing is helpful to prevent immediate firing of the firearm when the safety is released due to inadvertent pressing of the trigger while the safety is in the "safe" position, the bolt may not be drawn back for unloading or cleaning without rotating the safety lever clockwise toward the safety "fire" position. It is noted that the lever arm 21, bolt lock arm 32 and inner arm 24 of the safety mechanism disclosed in Walker constitute a single, unitary element for simultaneous pivoting about the pin 22 from the clockwise "fire" position to the counterclockwise "safe" position. The present invention improves on the Walker safety mechanism by providing a third position for the safety lever which permits the bolt lock arm 32 to be pivoted clockwise out of engagement with the notch 35 in the bolt, without the necessity to also disengage the eccentric 36 from the heel 37. This is disclosed in copending, parent U.S. patent application Ser. No. 680,328, incorporated herein by reference, and elaborated on below.

As shown in the drawings (see FIGS. 3 and 6), the safety mechanism 100 of the invention comprises a bolt lock member 101, a safety lever member 102 and a sear safety member 103 all being pivotally mounted for rotational movement from a first "fire" position to a second "safe" position about an assembly pin 22 which passes through apertures in the members 101, 102, 103 and through the side plates of trigger housing 4.

The bolt lock member 101 is the outermost member, as shown in FIGS. 1, 3 and 6. It includes a body portion 105 (FIG. 6) which includes a bore 106 through which the pin 22 passes, and has an elongated bolt lock arm portion 32 which extends upwardly and forwardly from the body portion 105 for rotation into bolt locking or unlocking position with respect to bolt notch 35 (FIG. 1). The safety lever 102 is an elongated element having an upper end 21 (FIG. 6) with an enlarged thumb manipulable head 107 extending transversely outwardly therefrom (see FIG. 2) and a lower blade-like end 108 formed with a longitudinally extending aperture 109 through which the pin 22 extends. The lower end 108 of the lever 102 includes a forward extension 110 which has an outwardly projecting boss 111 which projects through a second eccentric opening 112 in the body portion 105 of the bolt lock member 101.

The sear safety member 102 includes an inner, wrapped around portion 24 that is received between the side plates of the trigger housing 4 and is configured in a known way with an eccentric end 36 (FIG. 5) for pivotal movement about the assembly pin 22 from a clockwise "fire" position to a counterclockwise "safe" position in which the eccentric is disposed beneath the heel 37 of the safety cam 17, or similar heel of a one-piece sear arrangement. The sear safety member 103 further includes a body portion 115 (FIG. 6) that extends along the outside of the right side plate of trigger housing 4 interiorly to the members 101 and 102. The body portion 115 is formed with an outwardly facing elongated channel 116 dimensioned to snuggly receive the lower end 108 of the lever member 102 and permit movement of the member 102 axially of the elongated aperture 109 through which the pin 22 passes. Suitable means is provided to limit the axial travel of member 102 within the guide channel 116. As shown, this may be accomplished conveniently by providing a cutaway 117 in one wall of the channel 116 through which the extension 110 can pass, thereby providing upper and lower stops against which the extension 110 will abut. The sear safety member 103 is also provided in conventional manner with a hole 118 (FIGS. 3 and 6) formed in the forward extent of the body portion 103 to serve as a seat for loosely receiving therein a ball detent 119 (FIG. 6) which is biased by means of a leaf spring 26 into alternative engagement with one of two detent holes 121 formed in the sidewall of the trigger housing to releasably detain the member 103 in either its clockwise "fire" position or counterclockwise "safe" position. The ball detent arrangement is similar to that described in the Walker patent.

As seen, a lever return spring 122 is positioned within the longitudinal aperture 109 of the lever member 102 above the pin 22. The spring 122 serves to bias the member 102 into its upper position. The passage of the assembly pin 22 through aligned apertures in the members 101, 102 and 103 and through the sideplates of trigger housing 4 is seen in FIGS. 2, 4 and 6. A "C" clip or wishbone key 27 serves to retain the pin in position.

In operation, the safety 100 functions as follows: to bring the safety from the clockwise "fire" position (solid lines in FIGS. 1, 3 and 5) to the counterclockwise "safe" position (dot-and-dash lines), the outer end 21 of the lever 102 is rotated counterclockwise by the user about the assembly pin 22. Engagement of the boss 111 of member 102 with the sides of the eccentric opening 112 of the member 101 as the lever 102 is rotated causes the likewise rotation of the bolt lock member 101 bringing the bolt lock arm portion 32 thereof into the bolt notch 35, thereby blocking movement of the bolt. The rotation of the lever 102 to the dot-dash position (FIGS. 1 and 3) also causes counterclockwise rotation on the sear safety arm member 103 because of the engagement of the rear side of the lower end 108 of the lever 102 with the rear edge of the channel 116, to bring the eccentric end 36 of the member 103 into sear blocking engagement with the heel 37 (dot-dash lines in FIG. 5).

This simultaneous movement of the bolt lock arm 32 into bolt blocking position and the eccentric end 36 into sear (or trigger) blocking position is similar to the movement from the "fire" position to the "safe" position for the one-piece safety mechanism shown in the Walker patent. And, like the mechanism of the Walker patent, the detent ball arrangement functions to maintain the safety in its "safe" position until the lever 102 is intentionally rotated clockwise to bring it back to the "fire" position. Unlike the mechanism shown in the Walker patent, however, provision is made in the arrangement of the illustrated mechanism 100 in accordance with the invention to temporarily retreat the bolt lock end 32 of the member 101 out of engagement with the notch 35, to permit the bolt to be withdrawn for unloading or cleaning purposes without the necessity for rotating the lever arm 102 out of the "safe" position.

With the lever 21 in the "safe" position (dot-and-dashed lines in FIGS. 1 and 3) the lever 21 may be depressed to bring it temporarily into a third position (shown by dot-dot-dashed lines in FIG. 3) against the bias of the lever return spring 121, with the elongated aperture 109 moved axially down on the pin 22. This downward movement of the lever 102 within the channel 116 moves the extension 110 downward within the cutaway 117. The downward movement of the extension 110 and, thus,. the boss 111 relative to the fixed pivotal point of member 101 on the pin 22, causes the bolt lock arm 32 to temporarily pivot clockwise into the dot-dot-dashed position clear of the n.otch 35, as shown in FIG. 3. Because the axial movement of the lever 102 from the dot-dash position to the dot-dot-dash position occurs axially of the channel 116, thereby causing no movement of the sear safety member 103 about the pin 22, the eccentric 36 (FIG. 5) remains in engagement with the heel 37 of the safety cam/sear (dot-dashed position in FIG. 5). When the unloading or cleaning operation is complete and the bolt is to be returned to its previous position, a momentary depression of the lever 102 will again temporarily rotate the bolt lock arm portion 32 until the bolt is in position for the bolt lock arm 32 to again engage the notch 35. At this point, with the lever 102 again relaxed into its upwardly biased state, both bolt movement locking and sear movement blocking safety means will again be in place. The firearm can then be readied for firing, as desired, by clockwise rotation of the lever arm 21 from the "safe" to the "fire" position, pivoting of the bolt lock arm 32 being effected by contact of the boss 111 with the edge of the eccentric opening 112 and pivoting of the sear safety member end 36 being brought about by contact of the forward edge of the lever 102 with the forward edge of the channel 116.

In conclusion, there has thus been shown a fire control mechanism for a firearm having a trigger housing and a sear in which the trigger housing is equipped with a three-position or three-stage safety assembly which allows the breach bolt assembly to be released, lifted, rotated, and/or removed while the safety lever is in the "safe" or "no fire" position, simply by depressing the safety lever. The lever is restrained from being inadvertently moved to "fire" or the "safety off" position.

Although a single specific embodiment has been described and shown in detail for illustration purposes it should be understood that the invention is not to be considered limited to the exact embodiment disclosed. It is intended that all modifications and equivalents falling within the terms of the appended claims shall be considered as part of the invention.

What is claimed is:

1. In a safety mechanism for a firearm having a bolt including a slidable firing pin, a trigger housing, a sear movably mounted to said trigger housing for controlling the firing of said firing pin, and a safety pivotally mounted to said trigger housing for rotation about a pivot pin by means of manually induced pivotal movement of a lever arm portion of said safety between a "safe" position, in which a bolt lock arm portion of said safety is brought into bolt movement blocking position and an inner arm portion of said safety is brought into sear movement blocking position, and a "fire" position, in which movement of said bolt and sear are unobstructed by said safety, the improvement comprising:

means, responsive to translational movement of said lever arm portion while said safety is in said "safe" position, to temporarily back said bolt lock arm portion out of said bolt movement blocking position while said inner arm portion remains in said sear movement blocking position, whereby said bolt can be withdrawn without pivoting said safety toward said "fire" position.

2. A safety mechanism for a firearm having a bolt including a firing pin, a trigger housing, and a sear movably mounted to said trigger housing for controlling the firing of said firing pin, said safety mechanism comprising:

a bolt lock;

a safety lever;

a sear safety;

means mounting said bolt lock, safety lever and sear safety cooperatively to each other and to said trigger housing for simultaneously moving said bolt lock to a bolt movement blocking position and said sear safety to a sear movement blocking position in response to movement of said safety lever from a first to a second position, and for moving said bolt lock out of said bolt blocking position without moving said sear safety out of said sear movement blocking position in response to movement of said safety lever from said second to a third position.

3. A safety mechanism as in claim 2, further comprising resilient force means urging said lever into said second position from said third position.

4. A safety mechanism as in claim 3, wherein said resilient force member is a spring.

5. A safety mechanism as a claim 3, further comprising a spring-loaded ball being mounted on said sear safety and confined to move with said sear safety, a leaf spring bearing against said ball urging it into engagement with said trigger housing, said trigger housing having a first slot corresponding to said first position and a second slot corresponding to said second position, wherein said leaf spring urges said ball into said first slot for restraining said sear safety against rotation when said lever is in said first position, and into said second slot for restraining said sear safety against rotation when said lever is in said second and third positions.

6. A safety mechanism as in claim 2, wherein said bolt lock, safety lever, sear safety and trigger housing have aligned apertures, and where said mounting means comprises an assembly pin extending through said apertures.

7. A safety mechanism as in claim 6, wherein said mounting means further comprises means simultaneously pivoting said bolt lock and said sear safety about said assembly pin to their respective blocking positions in response to rotating of said lever about said assembly pin from said first to said second positions, and means for pivoting said bolt lock about said assembly pin out of said bolt blocking position in response to translational movement of said lever relative to said assembly pin from said second to said third positions.

8. A safety mechanism as in claim 7, wherein said lever comprises an elongated element, and wherein said means for pivoting said bolt lock in response to lever translational movement comprises means for pivoting said bolt lock in response to axially depressing said lever.

9. A safety mechanism as in claim 8, wherein said mounting means further comprises means mounting said safety lever between said bolt lock and said sear safety.

10. A safety mechanism as in claim 9, wherein said bolt lock has a body portion through which said assembly pin passes and a bolt locking arm portion which has an eccentric opening thereon; and said lever is formed with a longitudinally extending aperture through which said assembly pin extends and is also formed with a transversely extending portion including a projection which passes through said eccentric opening of said bolt lock.

11. A safety mechanism as in claim 10, wherein said sear safety has a body portion formed with an elongated channel oriented coaxially with respect to said lever and into which said lever is received for axial movement therein.

12. A safety mechanism for a firearm having a bolt including a firing pin, a trigger housing including oppositely disposed sidewalls, and a sear movably mounted to said trigger housing for controlling the firing of said firing pin, said safety mechanism comprising:

a sear safety having an inner, wrapped around portion which is located between said sidewalls and is configured with an eccentric end for rotation between sear blocking and unblocking positions, and further having a body portion located externally of said sidewalls which is formed with an outwardly facing elongated channel, said inner and body portions being formed with aligned apertures;

a safety lever located externally of said sear safety and comprising an elongated element having a manually manipulable upper end, and a blade-like lower end and coaxially received within said sear safety channel, said blade-like end being formed with a longitudinally extending aperture and also formed with a forwardly extending portion including a projection;

a bolt lock located externally of said safety lever and having a body portion formed with an aperture, said bolt lock also having an elongated arm portion formed with an eccentric opening receiving said projection of said lever and extending upwardly and forwardly from said body portion for rotation between bolt blocking and unblocking positions; and an assembly pin extending through said apertures of said sear safety, lever and bolt lock and pivotally mounting the same to said trigger housing, so that pivotal movement of said upper end of said lever from a first position to a second position about said assembly pin will simultaneously rotate said eccentric end from said sear unblocking to said sear blocking position and rotate said arm portion from said bolt unblocking to said bolt blocking position, and so that downward axial movement of said upper end of said lever from said second position to a third position will maintain said eccentric end in said sear blocking position but rotate said arm portion out of said bolt blocking position.

13. A safety mechanism as in claim 12, further comprising spring means biasing said upper end of said lever into said second position from said third position.

14. A safety mechanism as in claim 13, further comprising means for restraining said sear safety against rotation when said lever upper end is moved between said second and third positions.

15. A safety mechanism as in claim 14, wherein said sear safety lies adjacent to one sidewall of said trigger housing, and said restraining means comprises said one sidewall having a slot, a ball confined to travel with said sear safety body portion, and a leaf spring mounted on said body portion and urging said ball into engagement with said slot when said lever upper end is moved between said second and third positions.

* * * * *